US005950245A

United States Patent [19]

Binduga

[11] Patent Number: 5,950,245

[45] Date of Patent: Sep. 14, 1999

[54] ADJUSTABLE HEADBAND WITH A RATCHET MECHANISM HAVING DIFFERENT RESISTANCES

[75] Inventor: Gary E. Binduga, Pittsburgh, Pa.

[73] Assignee: Mine Safety Appliances Company, Pittsburgh, Pa.

[21] Appl. No.: 08/838,004

[22] Filed: Apr. 14, 1997

[51] Int. Cl.[6] ..... A42B 3/14

[52] U.S. Cl. ..... 2/417; 2/8; 2/183; 24/68 B

[58] Field of Search ..... 2/416, 417, 418, 2/419, 420, 421, 410, 183, 195.1, 195.2, 195.4, DIG. 11, 8; 24/68 B, 68 R, 68 SK

[56] References Cited

U.S. PATENT DOCUMENTS

| | | | |
|---|---|---|---|
| 2,205,741 | 6/1940 | Bowers | 2/8 |
| 2,205,742 | 6/1940 | Bowers | 2/8 |
| 2,511,234 | 6/1950 | Anderson | 2/8 |
| 2,926,406 | 3/1960 | Edwards et al. | 24/68 B |
| 3,041,622 | 7/1962 | Gurtowski | 2/8 |
| 3,047,876 | 8/1962 | Malcom, Jr. | 2/9 |
| 3,075,201 | 1/1963 | Linblom | 2/8 |
| 3,214,809 | 11/1965 | Edwards | 2/418 |
| 3,325,824 | 6/1967 | Donegan | 2/8 |
| 3,444,560 | 5/1969 | Northup, Jr. | 2/8 |
| 4,726,782 | 2/1988 | Hager et al. | 439/321 |
| 4,888,831 | 12/1989 | Oleson | 2/420 |
| 4,942,628 | 7/1990 | Freund | 2/416 |
| 4,984,995 | 1/1991 | Tucker et al. | 439/321 |
| 5,046,964 | 9/1991 | Welsh et al. | 439/271 |
| 5,321,416 | 6/1994 | Bassett et al. | 345/8 |
| 5,331,687 | 7/1994 | Kronenberger | 2/195.2 |
| 5,357,654 | 10/1994 | Hsing-Chi | 2/418 |
| 5,373,688 | 12/1994 | Hede et al. | 2/418 |

*Primary Examiner*—Michael A. Neas

*Attorney, Agent, or Firm*—James G. Uber; Henry E. Bartony, Jr.

[57] ABSTRACT

The present invention provides an adjustable headband for protective headgear with a ratchet mechanism having different resistances. The adjustable headband utilizes a ring gear assembly having a plurality of radially projecting teeth thereon. Each of the projecting teeth of the ring gear assembly has a first tooth side and a second tooth side which is different from the first tooth side. For example, each tooth of the ring gear assembly preferably has a first tooth angle on the first tooth side and a second, different tooth angle on a second tooth side. A spring assembly having at least one spring tooth projecting radially therefrom is connected to the adjustment knob. The spring assembly is positioned such that the at least one spring tooth meshes with the teeth of the ring gear assembly to provide resistance to the rotation of the adjustment knob. Because the first tooth angle of the ring gear assembly is different from and preferably less than the second tooth angle of the ring gear assembly, it is substantially easier to rotate the adjustment knob in the direction of tightening the headband than in the direction of loosening the headband.

16 Claims, 7 Drawing Sheets

ADJUSTABLE HEADBAND WITH A RATCHET MECHANISM HAVING DIFFERENT RESISTANCES

FIELD OF THE INVENTION

The present invention relates to a headband for protective headgear and particularly to a headband for a protective helmet wherein a ratchet mechanism having different resistances is used to adjust the circumference of the band.

BACKGROUND OF THE INVENTION

Most types of protective headgear worn by workers to protect them from falling objects are held on the worker's head by a suspension system. The suspension system, along with the helmet itself, act to absorb the shock of a falling object striking the worker's head. The suspension system is also used to hold the helmet on the worker's head.

The suspension is often a web-like support system comprising two or more strips of material that are arranged to cross each other. The ends of the strips are, for example, attached at four or more points around the interior circumference of the helmet. A band is then attached to the four or more points of the suspension to permit the helmet to be worn by the worker. To securely position the helmet on the worker's head, it is essential that the circumference of the headband be adjustable to fit the appropriate head size. A napestrap is often attached at one end of the band to achieve these results.

In the Staz-On® Suspension, currently available from Mine Safety Appliances Company of Pittsburgh, Pa., and described in U.S. Pat. No. 3,500,474, the disclosure of which is incorporated herein by reference, an adjustable napestrap is manually adjusted by the wearer. The two ends of the napestrap are connected and held in place by a slot-and-teeth arrangement. One end of the napestrap is formed with parallel rows of teeth. The other end of the napestrap is formed with parallel rows of slots. The size of the suspension can be adjusted by inserting the teeth of one end of the strap into the slots formed in the other end of the strap at the desired length.

The Fas-Trac® Suspension, currently available from Mine Safety Appliances Company of Pittsburgh, Pa., and described in U.S. Pat. No. 4,942,628, the disclosure of which is incorporated herein by reference, has an adjustable napestrap wherein the ends of the strap are connected, held in place, and adjusted by a ratchet mechanism. The ratchet mechanism generally operates on a gear-and-teeth or rack-and-pinion arrangement. The adjustment knob of the ratchet mechanism has attached to it at one end a set of cog teeth. These teeth are positioned inside a lateral section of the napestrap. The lateral section of the napestrap has rows of teeth formed along the inside of slots therein. By placing the cog teeth in contact with the slot, the size of the napestrap can be adjusted by turning the knob one direction to pull the strap ends closer together or turning the knob the other direction to force the ends apart. A spring-activated detent mechanism is typically included to resist undesirable rotation of the adjustment knob.

In general, the ratchet-type suspension is preferred over the slot-and-teeth suspension because the ratchet-type suspension generally can be adjusted more easily while on the head of the worker. There are, however, certain disadvantages to ratchet-type suspensions. For example, ratchet suspensions often have numerous component parts that must be assembled to operate the ratchet. The number of parts and the labor required to assemble the parts is quite costly.

Moreover, metallic parts must often be avoided to reduce the risk of electrical shock to workers exposed to electrical wires or equipment.

Finally, ratchet-type suspensions sometimes do not prevent loosening of the headband after the user has adjusted the headband to the size of the user's head. In that regard, during normal use, protective headgear often experiences forces that tend to expand the size of or loosen the headband. Unless the ratchet mechanism provides suitable resistance to such forces, the headband will loosen, requiring constant adjustment by the user.

It is, therefore, desirable to provide an adjustable headband with a ratchet mechanism that is inexpensive to make and assemble and can be easily tightened, while still providing adequate resistance to loosening of the headband during use thereof.

SUMMARY OF THE INVENTION

Generally, the present invention provides an adjustable headband for protective headgear. The adjustable headband comprises a band having a first end and a second end which overlap. The first end has a first elongated slot, and the second end has a second elongated slot. The first elongated slot and the second elongated slot are in general alignment when the first end and the second end of the band overlap. A first row of teeth is formed in a first edge of the first elongated slot, while a second row of teeth is formed in a second edge of the second elongated slot. The first row of teeth preferably oppose the second row of teeth.

The adjustable headband further comprises an adjustment knob having a gripping member at a first end and a plurality of radially projecting cog teeth at a second end. The second end of the adjustment knob is in operative connection with the first row of teeth and the second row of teeth in each of the first and second elongated slot, respectively, such that rotation of the adjustment knob causes lateral movement of the first and second elongated slots relative to each other.

The adjustable headband preferably further comprises a case having an arc-shaped channel adapted to receive the first end and the second end of the band. The case has a cavity adapted to seat a ring gear assembly therein such that the ring gear assembly is substantially prevented from rotating relative to the case. The case also has an outer opening to receive the adjustment knob and an inner opening in communication with the channel. The cog teeth of the adjustment knob extend through the inner opening into the channel to engage the first row of teeth on the first end of the band and the second row of teeth of the second end of the band.

The adjustable headband further comprises a ring gear assembly. The ring gear assembly comprises a ring gear having a plurality of radially projecting teeth thereon. A spring assembly is operatively connected to the adjustment knob and the ring gear assembly such that the spring assembly provides a restoring force which acts as a resistance to rotation of the knob. Preferably, the spring assembly is attached to the adjustment knob and is substantially prevented from rotating relative to the adjustment knob. The spring assembly comprises at least one spring tooth projecting radially. The spring assembly is positioned such that the at least one spring tooth meshes with the radially projecting teeth of the ring gear assembly. The spring assembly preferably comprises two nonmetallic, circular arch springs, each circular arch spring having a radially projecting tooth.

Each of the teeth of the ring gear assembly has a first tooth side and a second tooth side. The second tooth side is different from the first tooth side. For example, in one embodiment, each of the plurality of teeth preferably has a first tooth angle on the first tooth side and a second tooth angle on the second tooth side. The second tooth angle is different than the first tooth angle. In another embodiment, the first tooth side preferably has a different coefficient of friction (with respect to the material of the spring tooth) than that of the second tooth side.

Because the first tooth side is different from the second tooth side in the ring gear assembly, it is easier to rotate the adjustment knob in one direction than in the other direction. If the first tooth angle of the ring gear assembly is less than the second tooth angle of the ring gear assembly, for example, it is easier to rotate the adjustment knob in the direction wherein the spring tooth engages the second tooth angle of the ring gear assembly than to rotate the adjustment knob in the opposite direction. Likewise, if the first tooth side has a greater coefficient of friction than the coefficient of friction of the second tooth side, it is easier to rotate the adjustment knob in the direction wherein the spring tooth engages the second tooth angle of the ring gear assembly than to rotate the adjustment knob in the opposite direction.

The direction of rotation requiring greater torque preferably corresponds with the direction of rotation required to loosen the headband. In this manner, any undesirable loosening of the headband (often referred to as "back drive" and arising, for example, from accidental side collisions of the headgear) can be substantially prevented while allowing the size of the headband to be easily adjusted by the user while the wearing the headband.

BRIEF DESCRIPTION OF THE INVENTION

DETAILED DESCRIPTION OF THE INVENTION

Figure 1:
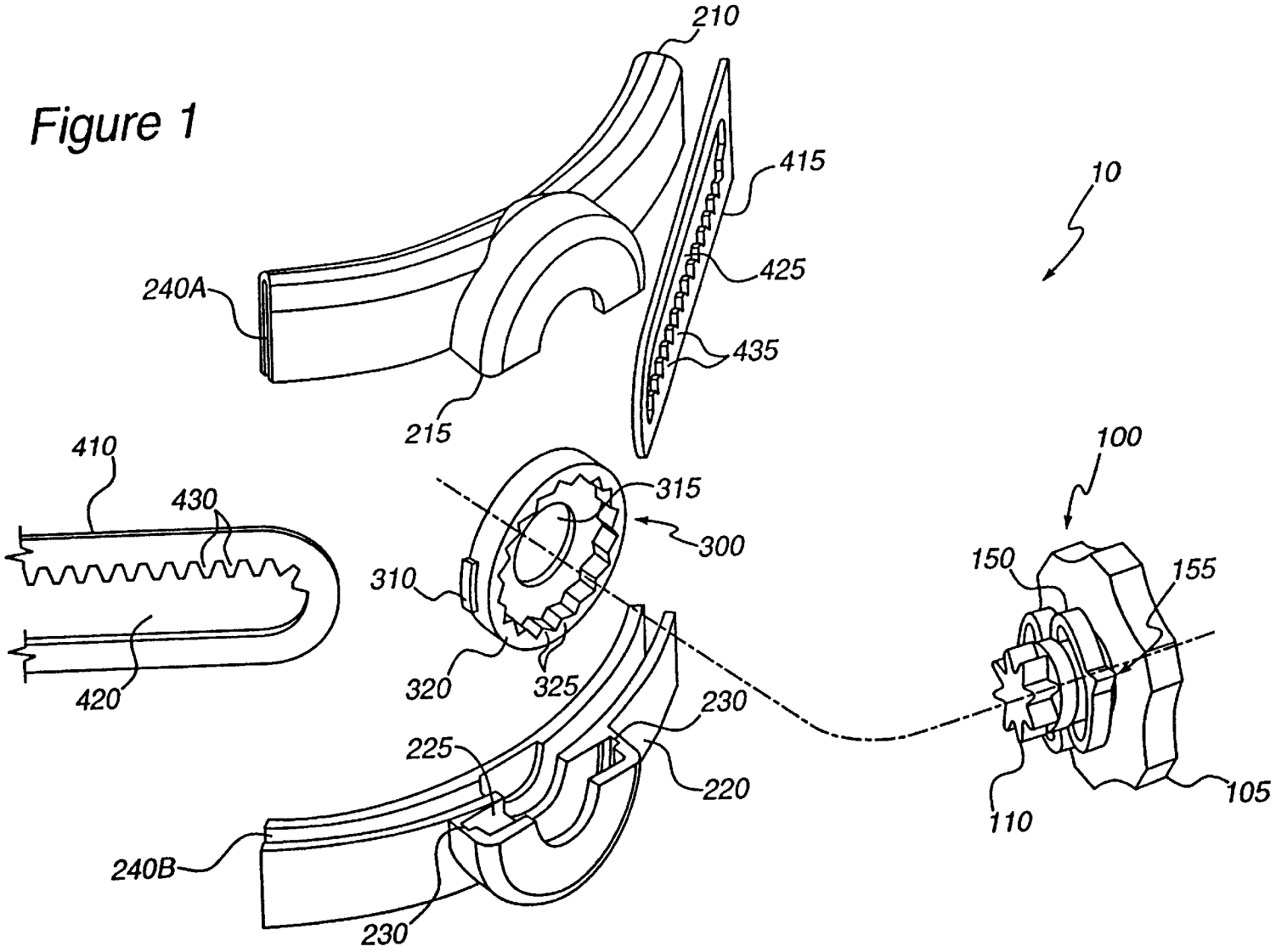
FIG. 1 illustrates a perspective view of a preferred embodiment of a headband adjustment mechanism of the present invention showing several disassembled components thereof.
Figure 2:
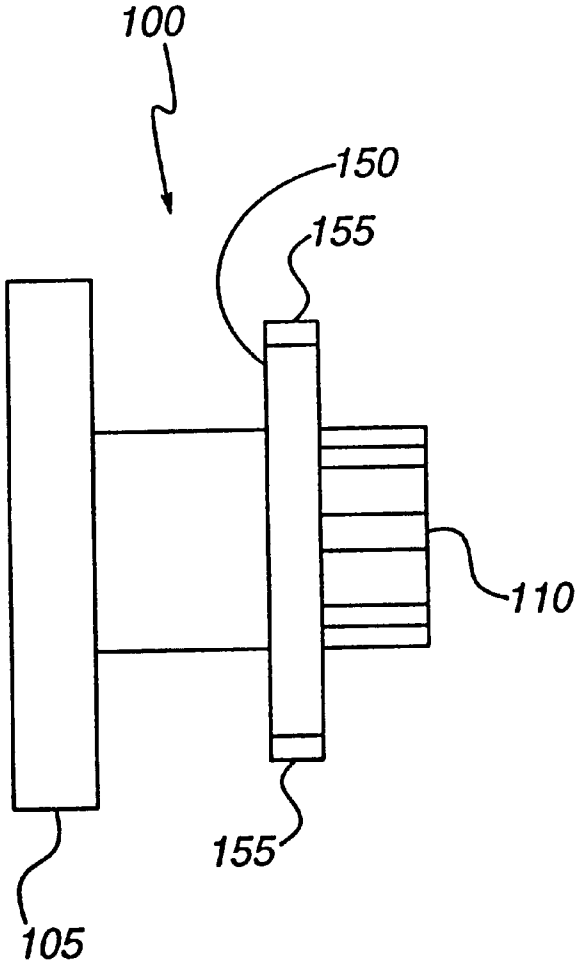
FIG. 2 illustrates a side view of the knob of FIG. 1.

Referring to FIGS. 1 and 2, ratchet mechanism 10 preferably comprises an adjustment knob 100 to enable the user to readily adjust the fit of a headband for a protective helmet. Knob 100 is preferably molded from a resilient polymeric material to have two integral sections. A first end section 105 provides an end piece or grip member suitable for gripping and turning by the wearer. A second end section of knob 100 is a generally circular cog 110 that is preferably axially molded to the knob 100. Disposed between cog 110 and grip 105 is preferably a spring assembly 150 (best illustrated in FIGS. 3 and 5).

Adjustment knob 100 is preferably placed inside a ratchet case 200 (see FIG. 7) comprising a top portion 210 and a bottom portion 220. Top portion 210 and bottom portion 220 of ratchet case 200 are preferably fabricated from a relatively rigid polymeric material such as polycarbonate. In the illustrated embodiment, bottom portion 220 of ratchet case 200 is a mirror image of top portion 210. Both top portion 210 and bottom portion 220 are preferably arc shaped. Top portion 210 and bottom portion 220 preferably comprise cavities 215 and 225, respectively, to receive and position a ring gear assembly 300. Ring gear assembly 300 is preferably fabricated from a relatively rigid polymeric material such as polycarbonate.

Ring gear assembly 300 is preferably fixed within ratchet case 200 so that it cannot move forward or rearward (axially) or rotate relative to ratchet case 200. Ring gear assembly 300 can, for example, comprise tabs 310 which cooperate with slots 230 formed in top portion 210 and bottom portion 220 of ratchet case 200. In the illustrated embodiment, ring gear assembly 300 also comprises a passage 315 therein to allow cog 110 to enter an arcuate channel 240 formed in ratchet case 200. Ring gear assembly 300 further comprises a ring gear 320 having teeth 325 which cooperate with at least one spring tooth 155 on spring assembly 150 to provide resistance to rotation of adjustment knob 100. Preferably, at least two opposing spring teeth 155 are provided.

Although radially outward projecting ring gear teeth 325 cooperate with radially inward projecting spring teeth 155 in the illustrated embodiment, as clear to one skilled in the art, other relative orientations are possible. For example, a spring with radially inward projecting teeth can cooperate with a ring gear with radially outward projecting teeth.

Upon assembly of adjustment mechanism 10, cog 110 of adjustment knob 100 is positioned inside of two lateral slots 420 and 425 formed in a first end 410 and a second end 415, respectively, of a napestrap. Along the top edge of lateral groove 420, a row of teeth 430 is cut into the napestrap suitable to engage the teeth of cog 110. Likewise, along the bottom edge of lateral groove 425, a second row of teeth 435 is formed, again to engage the teeth of cog 110. First and second ends 410 and 415 of the napestrap are threaded through a passage 240 to be in overlapping, adjacent engagement. Slots 420 and 425 are in general alignment in the area of overlap. The teeth of cog 110 engage teeth 430 and 435 of first end 410 and second end 415, respectively in the area of overlap.

Figure 7:
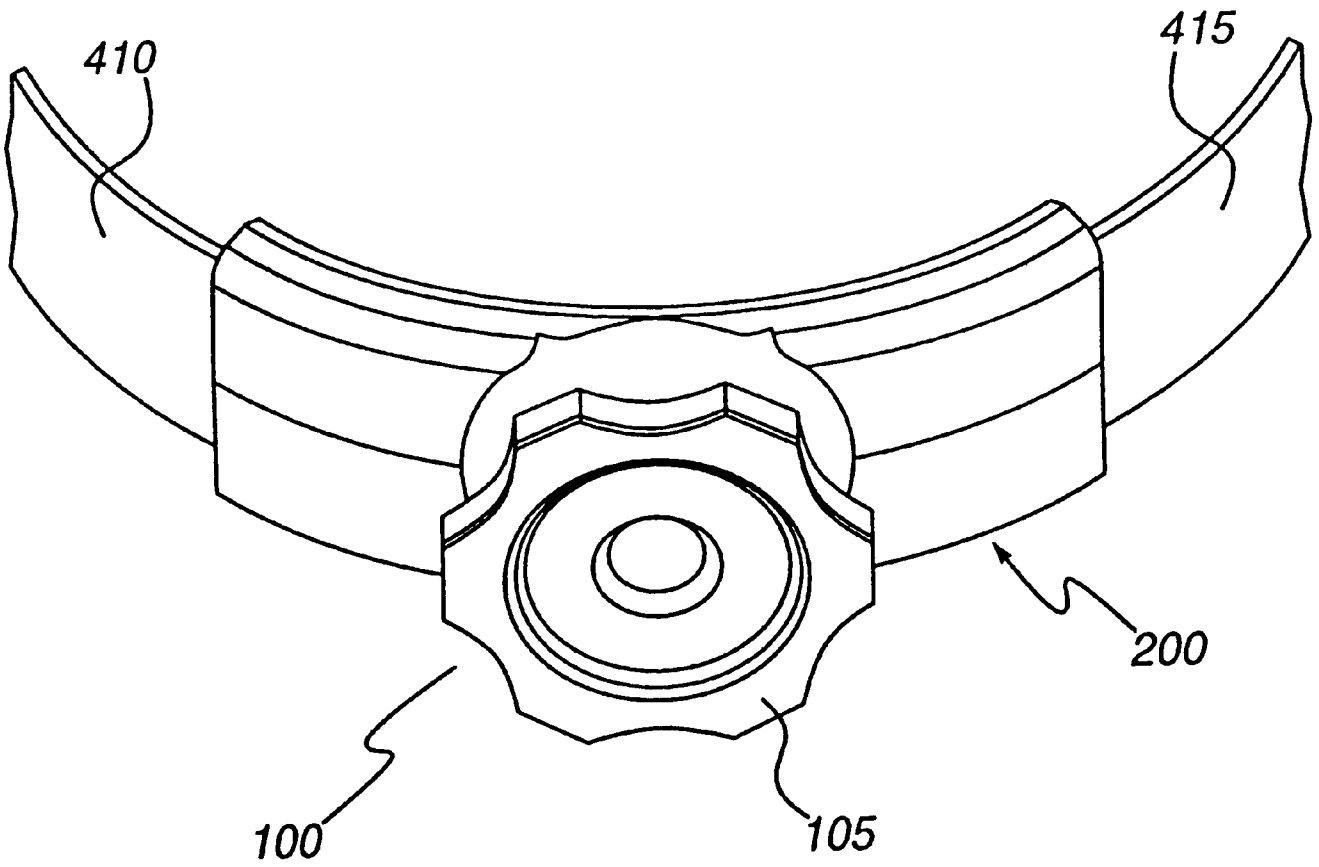
FIG. 7 illustrates the assembled headband adjustment mechanism of FIG. 1.

Passage 240 is preferably formed by a channel 240A in top portion 210 and a channel 240B in bottom portion 220 when top portion 210 and bottom portion 220 of ratchet case 200 are connected. Top portion 210 and bottom portion 220 are fixedly connected (for example, by gluing or sonic bonding as known in the art) to ratchet case 200. Assembled ratchet case 200 is illustrated in FIG. 7.

The adjustment of the napestrap and thereby the fit of the headgear (not shown) is achieved either by (i) turning knob 100 one direction (for example, clockwise) to draw first strap end 410 and second strap end 415 closer together (that is, to increase the area of overlap) or (ii) by turning knob 100 in the opposite direction to push first strap end 410 and second strap end 415 farther apart (that is, to decrease the area of overlap).

Figure 3:
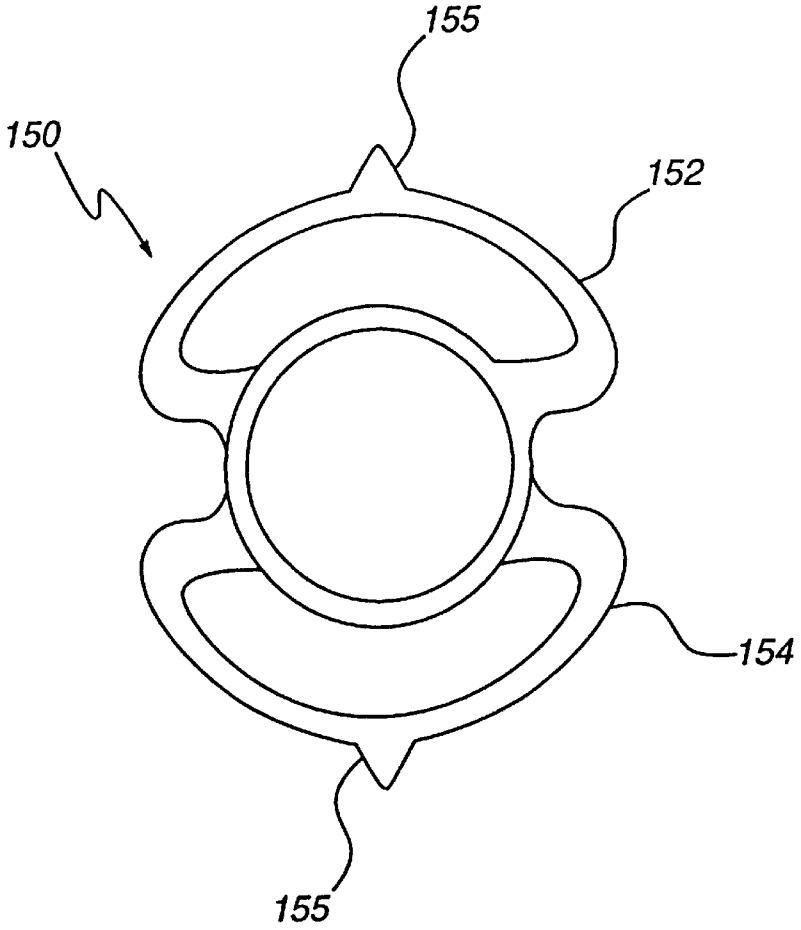
FIG. 3 illustrates a front view of one embodiment of a spring assembly of the present invention.
Figure 4:
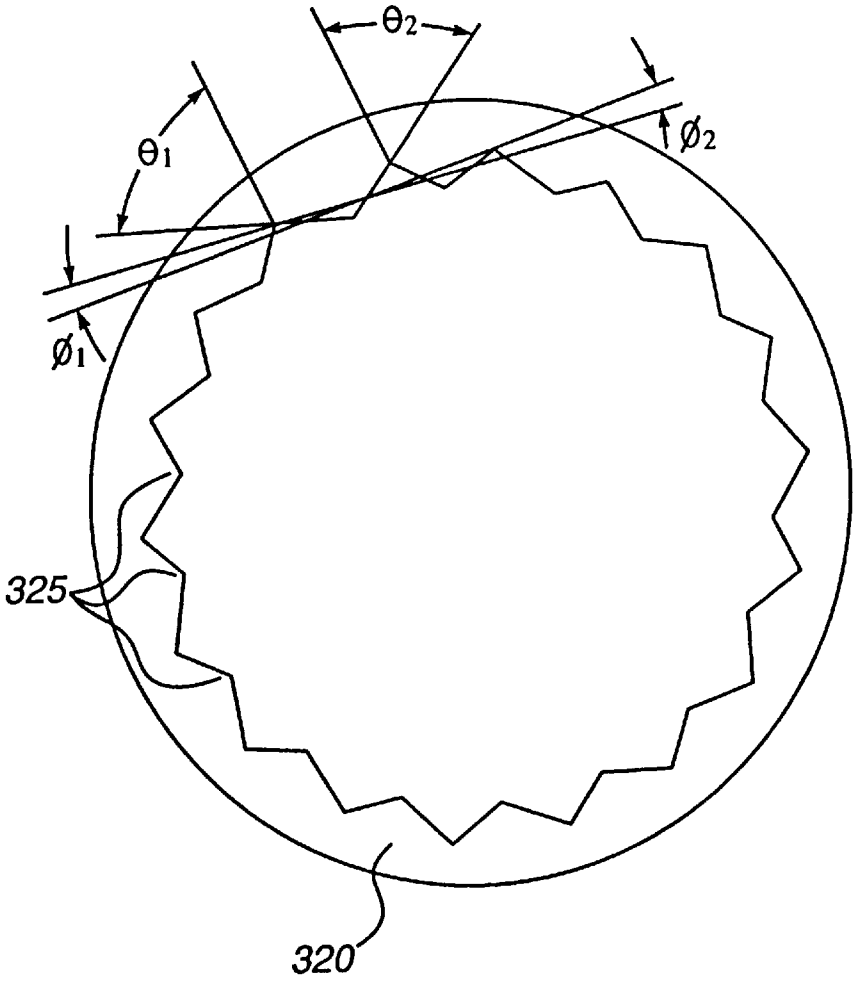
FIG. 4 illustrates one embodiment of a ring gear of the present invention.
Figure 5:
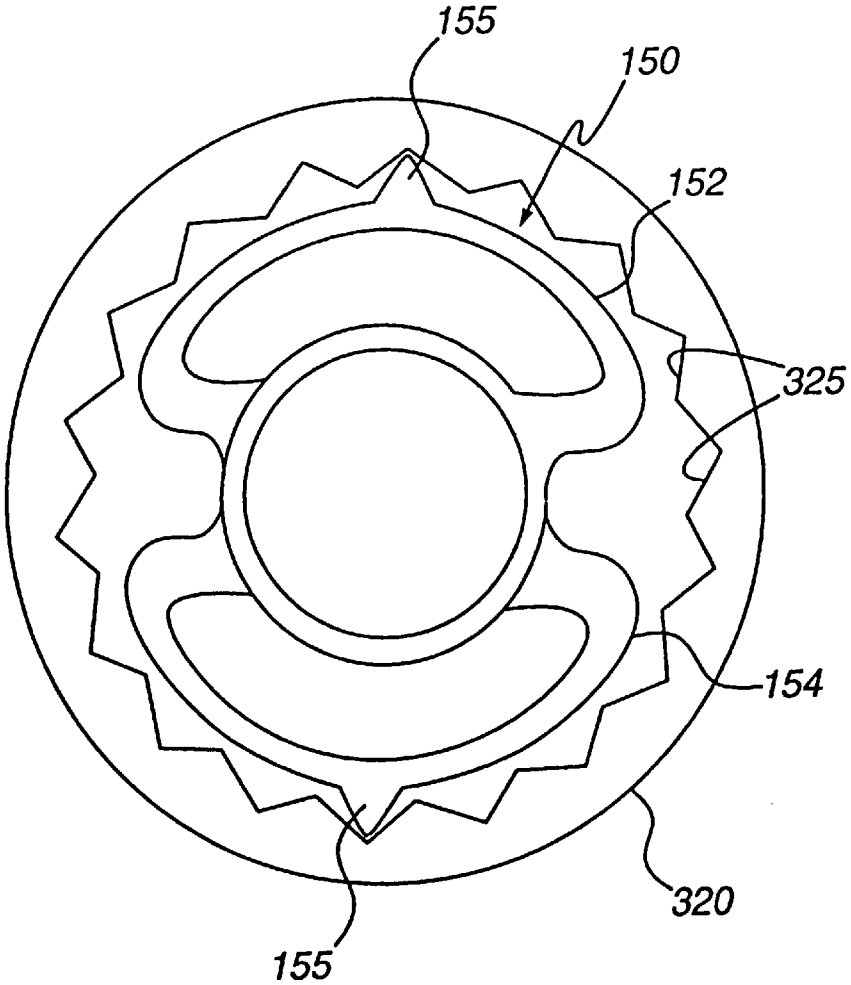
FIG. 5 illustrates the cooperating action of the ring gear of FIG. 4 and the spring assembly FIG. 3.
Figure 6:
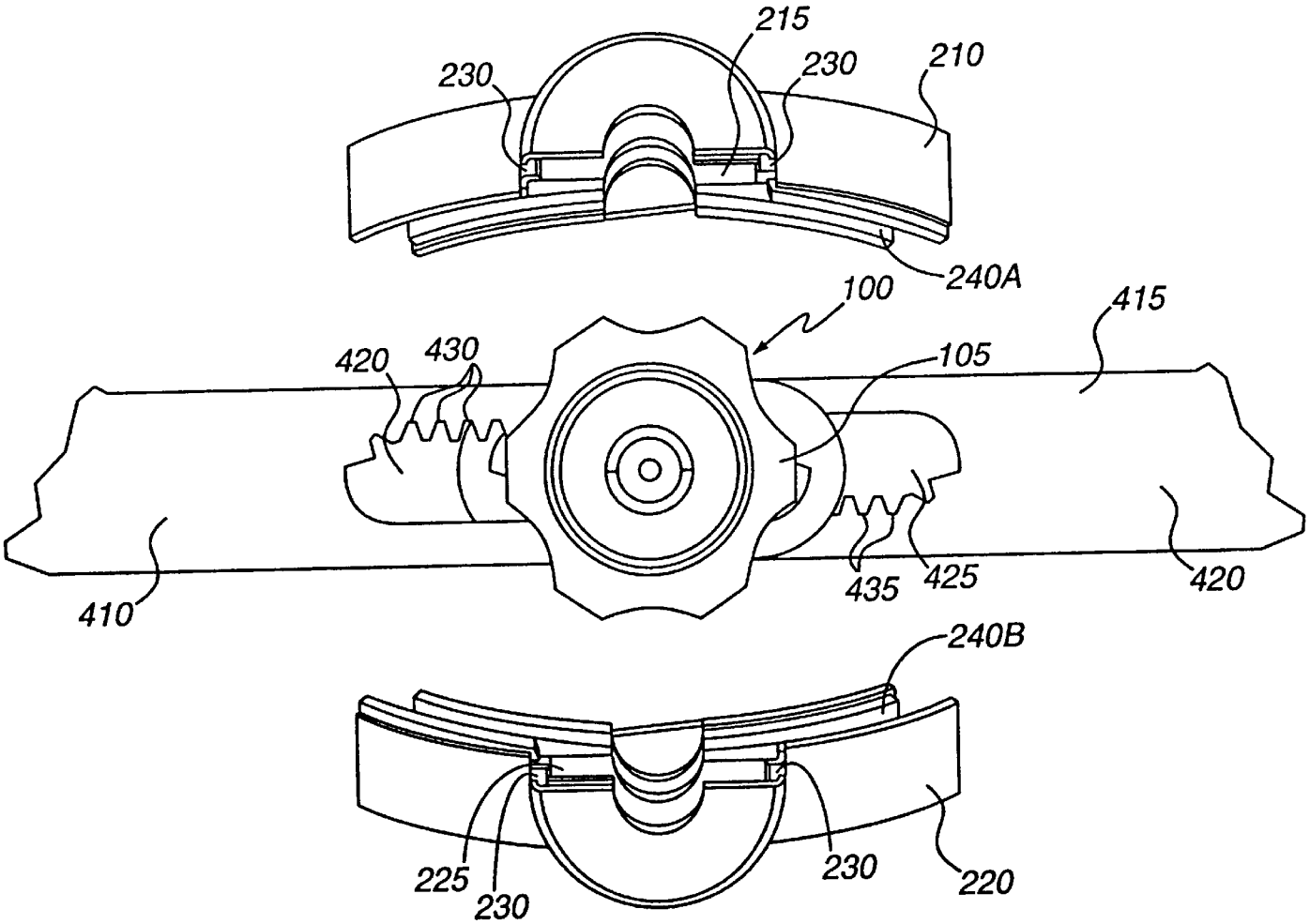
FIG. 6 illustrates a front view of the adjustment mechanism of FIG. 1 showing the cooperation of the cog teeth of the adjustment knob and the cog teeth of the napestrap ends.

Resistance to rotation of knob 100 and thereby cog 110 to change the fit of the headgear suspension is provided by the spring force produced by spring assembly 150 as spring teeth 155 impinge upon the ring gear 320. Spring assembly is preferably fabricated from a nonmetallic polymeric material such as a thermoplastic elastomeric material. Preferably, spring assembly 150 comprises two opposing circular arch springs 152 and 154 as best illustrated in FIGS. 3 and 5. For small deflections, circular arch springs provide a substantially linear spring rate. As knob 100 is turned, spring teeth 155 are forced over teeth 325 of ring gear 320 by radially inward compression of spring assembly 150. In that regard, as the knob 100 is turned, spring assembly 150 is compressed radially inward as spring teeth 155 "ride" over teeth 325. Once spring teeth 155 pass over teeth 325, spring teeth 155 enter the valleys between the teeth 325 as the restoring force of spring assembly 150 forces spring teeth 155 radially outwardly. To turn knob 100, the user must supply sufficient torque to overcome the force of the spring assembly 150.

Preferably, the torque required to loosen the fit of the headgear suspension is greater than the torque required to tighten the fit of the headgear suspension. In this manner, easy adjustment of the fit by the user is possible, but the suspension resists undesirable loosening (caused, for example, by accidental side impacts of the headgear) during use thereof.

In general, the torque resisting capacity of a serrated clutch/detent mechanism such as the combination of ring gear assembly 300 and spring assembly 150 is given by the following equation:

$$T=RFK$$

where:

T is the torque required to turn past a detent.

R is the effective radius of the serrated clutch-knob.

F is the restoring force of the spring return mechanism.

K is a parameter determined based upon tooth angle and coefficient of friction.

Canick, L. N., "Serrated Clutches and Detents," *Product Engineering Design Manual*, Greenwood, D. C., ed., McGraw-Hill Book Company, Inc., New York, (1959), the disclosure of which is incorporated herein by reference. The value of K is provided by the following equation:

$$K=(1+\mu\tan\theta)/(\tan\theta-\mu)$$

where:

$\mu$ is the coefficient of friction $\theta$ is the angle of the tooth face in degrees.

A condition of equilibrium for the forces acting on a tooth of ring gear assembly 300, leads to the following equation:

$$T=RF/((\cos\phi)/K-\sin\phi)$$

where:

$\phi$ is the pressure angle in degrees.

From the above equations it is seen that the toque T required to turn knob 100 depends in part upon tooth angle $\theta$. One can thus have different K's (for example, $K_1$ in a tightening direction and $K_2$ in a loosening direction) and, therefore, different torques required to turn knob 100 in a tightening direction than in the opposite, loosening direction by providing different tooth angles $\theta_1$ and $\theta_2$, and corresponding angles $\phi_1$ and $\phi_2$. See FIG. 3. As clear to one skilled in the art, a ratchet mechanism having a desired tightening torque and a different, desired loosening torque can be readily designed using the above equations.

In one embodiment, the coefficient of friction between the material of the spring teeth 155 and the material of the ring gear teeth 325 was approximately 0.2 and was assumed to be constant. $\theta_1/\theta_2$ was approximately 1.25, and $\phi_1/\phi_2$ was approximately 0.625. These parameters resulted in a ratio $T_{loosen}$:$T_{tighten}$: of approximately 1.7:1 (wherein $T_{loosen}$ is the torque required to turn adjustment knob 110 in the loosening direction and $T_{tighten}$ is the torque required to turn adjustment knob 110 in the tightening direction). Preferably, the ratio $T_{loosen}$:$T_{tighten}$ is in the range of approximately 1.5:1 to 3:1. More preferably, $T_{loosen}$:$T_{tighten}$ is in the range of approximately 1.5:1 to 2.5:1.

In another embodiment of the present invention, a similar result can be obtained using a ring gear assembly having only a single tooth angle (that is, $\theta_1=\theta_2$), but in which the coefficient of friction (with respect to the material of spring teeth 155) on one side of each tooth of the ring gear assembly is different from the coefficient of friction on the other side of each tooth. In all other respects, this embodiment of the present invention is preferably substantially the same as described above. Different coefficients of friction on either side of a ring gear assembly tooth may be accomplished, for example, by choosing a different material for the first side of the tooth than for the second side of the tooth. Likewise, the tooth can be fabricated from one material, but the first side of the tooth may be less smooth than the second side of the tooth. As clear to one skilled in the art, the torque required to turn adjustment knob 110 in the direction of the first side of the ring gear assembly teeth (that is, the side having the smaller coefficient of friction) will be less that the torque required to turn adjustment knob 110 in the direction of the second side of the ring gear assembly teeth. The differences in torque required to turn adjustment knob 110 in different directions can be increased even further using a combination of different tooth angles and coefficients of friction.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. An adjustable headband comprising a. a band having a first end and a second end which overlap, the first end having a first elongated slot and the second end having a second elongated slot, a first row of teeth being formed in a first edge of the first elongated slot, a second row of teeth being formed in a second edge of the second elongated slot, the first elongated slot and the second elongated slot being in general alignment;

b. an adjustment knob having a gripping member at a first end and a plurality of cog teeth at a second end such that rotation of the adjustment knob results in rotation of the cog teeth, the cog teeth engaging the first row of teeth and the second row of teeth to cause lateral displacement of the first elongated slot relative to the second elongated slot when the adjustment knob is rotated;

c. a ring gear assembly comprising a plurality of radially extending teeth wherein each tooth has a first tooth angle on a first side thereof and a second tooth angle on a second side thereof, the second tooth angle being different than the first tooth angle;

d. a spring assembly comprising at least one spring tooth projecting radially therefrom, the spring assembly being positioned such that the at least one spring tooth meshes with the teeth of the ring gear assembly, the spring assembly thereby providing a first level of resistance to rotation of the adjustment knob in a first direction and a second level of resistance to rotation of the adjustment knob in a second direction.

2. The adjustable headband of claim 1 wherein the spring assembly comprises two circular arch springs, each circular arch spring comprising at least one radially extending tooth.

3. The adjustable headband of claim 2 wherein each of the circular arch springs comprises one radially extending tooth, the circular arch springs being positioned such that the radially extending teeth are approximately 180° apart.

4. The adjustable headband of claim 2 wherein each circular arch spring is fabricated from a thermoplastic elastomeric material.

5. The adjustable headband of claim 1 further comprising a case, the case comprising an arc-shaped channel adapted to receive the first end and the second end of the band, the case further comprising a cavity adapted to seat the ring gear assembly therein such that the ring gear assembly is substantially prevented from rotating relative to the case, the case having an outer opening to receive the adjustment knob, the case having an inner opening in communication with the channel through which the cog teeth extend to engage the first row of teeth and the second row of teeth in the channel.

6. The adjustable headband of claim 1 wherein a ratio of a torque required to tighten the headband to a torque required to loosen the headband is in the range of approximately 1.5:1 to 3:1.

7. The adjustable headband of claim 6 wherein the ratio of the torque required to tighten the headband to the torque required to loosen the headband is in the range of approximately 1.5:1 to 2.5:1.

8. An adjustable headband comprising a. a band having a first end and a second end which overlap, the first end having a first elongated slot and the second end having a second elongated slot, a first row of teeth being formed in a first edge of the first elongated slot, a second row of teeth being formed in a second edge of the second elongated slot, the first elongated slot and the second elongated slot being in general alignment;

b. an adjustment knob having a gripping member at a first end and a plurality of cog teeth at a second end such that rotation of the adjustment knob results in rotation of the cog teeth, the cog teeth engaging the first row of teeth and the second row of teeth to cause lateral displacement of the first elongated slot relative to the second elongated slot when the adjustment knob is rotated;

c. a ring gear assembly comprising a plurality of radially extending teeth wherein each tooth has a first tooth side and a second tooth side, the first tooth side being different from the second tooth side;

d. a spring assembly comprising at least one spring tooth projecting radially therefrom, the spring assembly being positioned such that the at least one spring tooth meshes with the teeth of the ring gear assembly, the spring assembly thereby providing a first level of resistance to rotation of the adjustment knob in a first direction and a second level of resistance to rotation of the adjustment knob in a second direction.

9. The adjustable headband of claim 8 wherein the spring assembly comprises two circular arch springs, each circular arch spring comprising at least one radially extending tooth.

10. The adjustable headband of claim 9 wherein each of the circular arch springs comprises one radially extending tooth, the circular arch springs being positioned such that the radially extending teeth are approximately 180° apart.

11. The adjustable headband of claim 9 wherein each circular arch spring is fabricated from a thermoplastic elastomeric material.

12. The adjustable headband of claim 8 further comprising a case, the case comprising an arc-shaped channel adapted to receive the first end and the second end of the band, the case further comprising a cavity adapted to seat the ring gear assembly therein such that the ring gear assembly is substantially prevented from rotating relative to the case, the case having an outer opening to receive the adjustment knob, the case having an inner opening in communication with the channel through which the cog teeth extend to engage the first row of teeth and the second row of teeth in the channel.

13. The adjustable headband of claim 8 wherein the first tooth side has a first coefficient of friction relative to the spring tooth and the second tooth side has a second coefficient of friction relevant to the spring tooth, the first coefficient of friction being different from the second coefficient of friction.

14. The adjustable headband of claim 8 wherein the first tooth side has a first tooth angle and the second tooth side has a second tooth angle, the first tooth angle being different from the second tooth angle.

15. The adjustable headband of claim 8 wherein a ratio of torque required to tighten the headband to a torque required to loosen the headband is in the range of approximately 1.5:1 to 3:1.

16. The adjustable headband of claim 15 wherein the ratio of the torque required to tighten the headband to the torque required to loosen the headband is in the range of approximately 1.5:1 to 2.5:1.

* * * * *